United States Patent [19]

Gerhard

[11] Patent Number: 4,728,000

[45] Date of Patent: Mar. 1, 1988

[54] TRANSPORT CONTAINER

[75] Inventor: Helmut Gerhard, Weitefeld, Fed. Rep. of Germany

[73] Assignee: Westerwaelder Eisenwerk Gerhard GmbH, Weitefeld, Fed. Rep. of Germany

[21] Appl. No.: 55,039

[22] Filed: May 28, 1987

[30] Foreign Application Priority Data

Jun. 5, 1986 [DE] Fed. Rep. of Germany ..... 3618900

[51] Int. Cl.[4] ..... B65D 88/06

[52] U.S. Cl. ..... 220/71; 220/1 B; 220/1.5; 220/84

[58] Field of Search ..... 220/71, 84, 1 B, 1.5, 220/5 A

[56] References Cited

U.S. PATENT DOCUMENTS

| | | | |
|---|---|---|---|
| 2,477,831 | 8/1949 | Schmitz, Jr. | 220/1 B |
| 3,730,384 | 5/1973 | Ramme | 220/71 |
| 3,912,103 | 10/1975 | Gerhard | 220/1.5 |
| 3,971,491 | 7/1976 | Larssen et al. | 220/1.5 X |
| 4,060,174 | 11/1977 | Gerhard | 220/84 X |
| 4,065,022 | 12/1977 | Cainaud | 220/1.5 X |
| 4,307,812 | 12/1981 | Gerhard | 220/5 A X |
| 4,412,626 | 11/1983 | Gerhard | 220/1.5 |
| 4,416,384 | 11/1983 | Bjurling | 220/1.5 |
| 4,469,236 | 9/1984 | Marsault et al. | 220/1.5 |
| 4,593,832 | 6/1986 | Gerhard . | |
| 4,615,453 | 10/1986 | Taguoi | 220/71 |

FOREIGN PATENT DOCUMENTS 2013624 8/1979 United Kingdom .

*Primary Examiner*—Steven M. Pollard
*Attorney, Agent, or Firm*—Barnes & Thornburg

[57] ABSTRACT

An end mounting between the tank (10) and an end frame (11) of a small or medium size container comprises four tubular sections (21) which are welded with their respective one end edge to the spherically curved main portion (13) of the tank end (12) and with their respective other end edge to a leg (23) of a diagonal strut (20) which is formed by an L-bar and bridges a respective corner of the end frame (11).

10 Claims, 7 Drawing Figures

TRANSPORT CONTAINER

Figure 1:
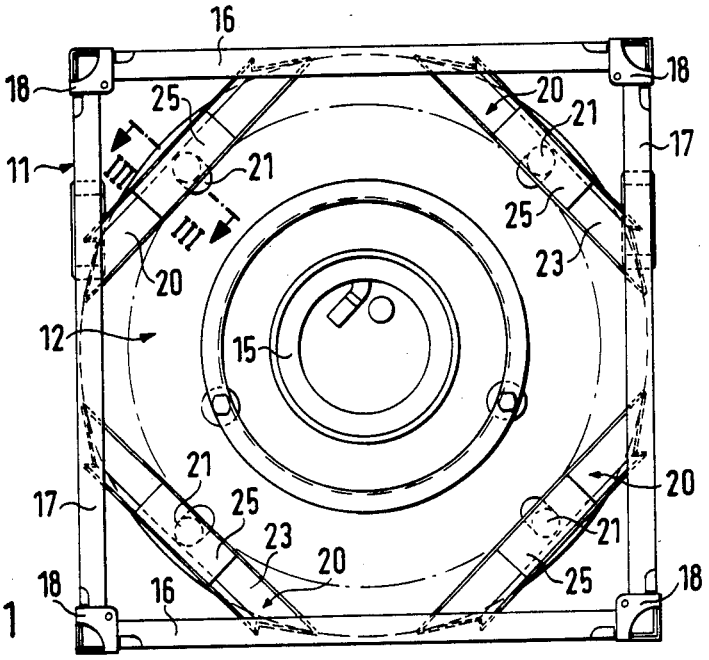

This invention is directed to a transport container including a tank mounted between a pair of end frames.

With such a transport container, which is known from U.S. application Ser. No. 4,593,832, the tank is joined to two end frames by means of an end ring attached to the tank and a mounting ring fixed to the respective end frame, wherein the mounting ring and the end ring interengage with flanges that extend in the axial direction of the tank and are welded to each other.

In practical use, the known mounting structure has proven to be suited for accommodating all loads possibly occurring during road and rail transport and to be fatigue resistant. Moreover, it exhibits a feature which is of importance in respect of manufacture and which resides in the fact that the interengaging end and mounting rings, prior to their being finally welded, permit relative movement during assembly to compensate for length tolerances. Such tolerances are hardly avoidable during manufacture of the tank which is normally welded from several plate rings and two ends, and are also caused by distortions of the tank ends themselves.

The known double-ring concept is suited for transcontainers having a useful volume of for example 30 tons (approx. 300 kN), whereas it is frequently too heavy and expensive for small and medium size tank containers.

It is a general object of the invention at least partially to eliminate drawbacks of the kind occurring with comparable prior art tank containers. As a more specific object, a mounting for the end connection between tank and end frame is to be devised, which should be especially suitable for small and medium size tank containers, incur minimum material costs and manufacturing effort and have reduced weight.

This object is met by a transport container which in accordance with the invention comprises a cylindrical tank, the tank ends of which each include a spherically curved main portion, two rectangular end frames each having four diagonal struts for bridging the corners thereof, and mounting structures inserted between the spherical main portion of each tank end and the diagonal struts of the respective end frame, wherein each mounting structure comprises four circular-cylindrical tubular sections each extending at an acute angle to the tank axis and being joined with its one cut edge to the main portion of the respective tank end and with its other cut edge to a diagonal strut of the respective end frame, each tubular section having a diameter which is smaller by a multiple than the diameter of the tank and a length which is substantially of the order of its diameter.

The four tubular sections which join each tank end to the associated end frame and which have diameters many times smaller than the diameter of the tank (and the diameter of the known end and mounting rings) may be formed of constructional or special steel tubing. Their circular cut edges facing the tank end can be welded to the spherically curved main portion of the tank end without any gap therebetween at such an angle that any loads are introduced from the tank end in a straight line into the respective corner strut provided in the end frame, thus into the region which is adjacent one of the support points of the transport container, viz. the corner of the end frame commonly provided with a corner fitting.

In this connection the diagonal struts which are required in conjunction with such tubular sections and which bridge the corners of the end frame, not only result in a suitable strengthening of the end frame but are convenient also insofar as they leave the central portion of the end frame free so that the tank may enter the end frame with the highest point of curvature of the tank end lying in the outer surface of the end frame, said outer surface determining the external dimensions of the transport container. Therefore the volume defined by the two end frames can be optimally utilized.

At the same time, the distance between the diagonal struts of the end frame and the curvature of the tank end is small so that the tubular sections may be correspondingly short and light-weight, which is favorable not only with a view to weight and cost but also from static aspects. Finally, it is also important that the tubular sections are attached to the tank end by an endless weld so that any peak stresses are prevented.

A tank container in which the tank is connected to container end frames by means of tubular sections is known from GB-A- No. 2,013,624. There, however, the tubular sections extend between a reinforcing ring surrounding the cylindrical main part of the tank and corners of the respective end frame, so that they are required to have considerable lengths. This in turn results in a connecting structure of low stability, particularly with respect to transverse forces. To increase the stability of the tubular sections, their dimensions and/or their number may be increased (the document actually shows a total of 16 tubular elements to connect the tank to the two end frames); but this results in an undesirable increase of the net weight of the tank container. Furthermore, the construction shown in this reference does not permit the easy compensation of manufacturing tolerances described above in connection with the invention.

Further advantageous features of the invention relate to compensating tolerances during assembly and increasing the structural stability of the tank-end frame connection.

Figure 2:
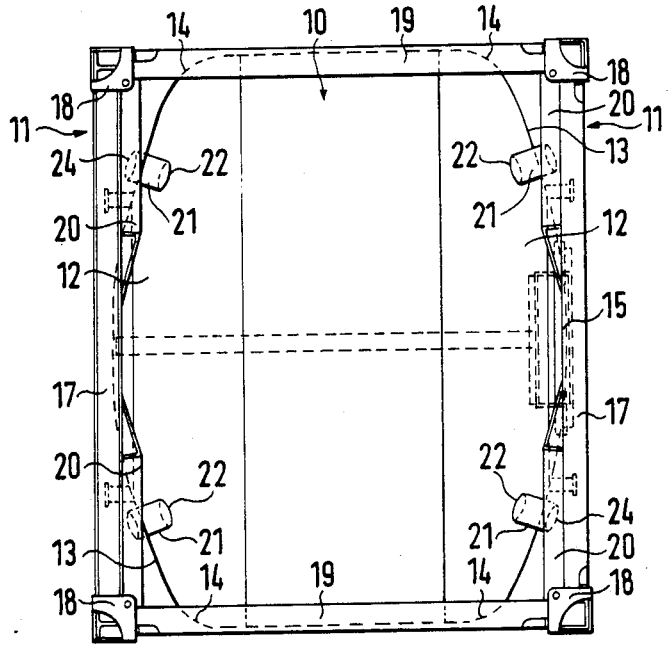
Figure 3:
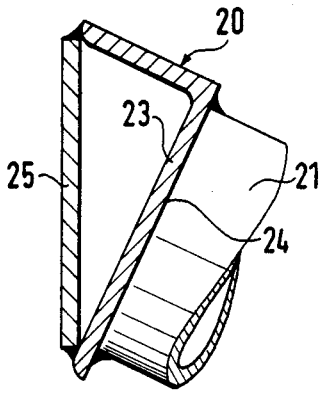
Figure 4:
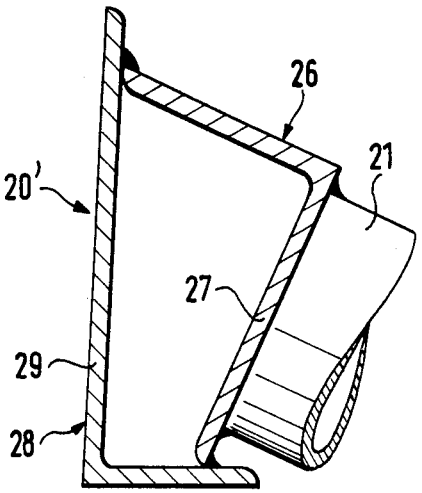
Figure 5:
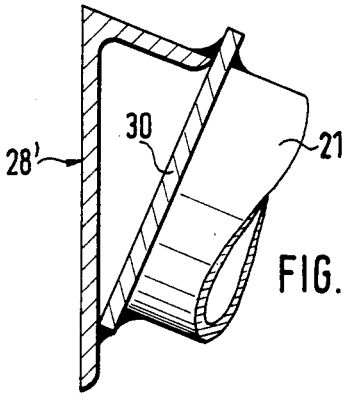
Figure 6:
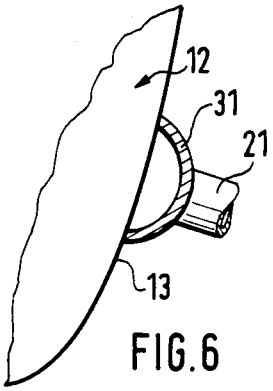
Figure 7:
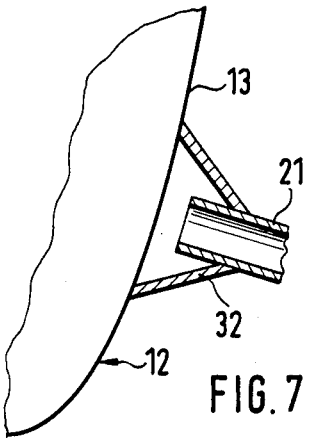

Preferred embodiments of the invention will be described in detail below with reference to the drawings, in which FIG. 1 is an end view of a transport container, FIG. 2 is a side view of the transport container illustrated in FIG. 1, FIG. 3 is a sectional view along the line III—III of FIG. 1 through a diagonal strut, FIGS. 4 and 5 are alternatives for the design of a diagonal strut similar to what is shown in FIG. 3, and FIGS. 6 and 7 are alternatives relating to the connection between a tubular section and the tank end.

The tank container illustrated in FIGS. 1 and 2 comprises a tank 10 and two end frames 11. The tank 10 is composed of a central cylindrical part and tank ends 12 attached to either end thereof. Each tank end 12, which according to FIG. 2 is dish-shaped, includes a spherically curved main portion 13 verging into a knuckle zone 14 of greater curvature. The main portion 13 of the tank end 12 visible in FIG. 1 and positioned to the right in FIG. 2 is provided with a central manhole 15 having various fittings disposed therein.

As shown in FIG. 1, each end frame 11 comprises top and bottom crossbars 16 as well as right-hand and left-hand corner supports 17. The crossbars 16 and corner supports 17 are joined to each other by means of corner fittings 18. As will be apparent from FIG. 2, the two end frames 11 are furthermore joined to each other by means of longitudinal bars 19 each starting from the corner fittings 18. According to FIG. 1, each end frame 11 furthermore comprises four diagonal struts 20 each bridging a corner constituted by a crossbar 16 and a corner support 17. The four diagonal struts 20 are arranged so as to leave out a substantially octagonal central area of the end frame 11 into which the central curved portion of the tank end 12 enters.

Each tank end 12 is joined by way of four tubular sections 21 to the four diagonal struts 20 of the respective end frame 11. Each tubular section 21 is a circular cylinder and is cut so that the end faces formed by the cut edges are normal to the axis of the tubular section. Thereby a circular cut edge 22 results also at the end facing the tank 10, which cut edge 22 can be welded without any gap to the spherically curved main portion 13 of the tank end 12. The four tubular sections 21 start from the main portion 13 of the tank end 12 surrounded by the knuckle zone 14 at locations where their axes extend at acute angles to the longitudinal axis of the tank 10.

As will be apparent from FIGS. 1 to 3, each diagonal strut 20 consists of a rectangular-section L-bar having legs of different width. The edges of the two legs of each L-bar are welded at either end to a surface of a crossbar 16 facing the tank 10 and to a corner support 17. The widths of the two legs of the L-bar are selected such that the outer surface of the wider leg 23 is normal to the axis of the respective tubular section 21 whose cut edge 24 is welded to said surface. As will be apparent from FIGS. 1 and 3, that portion of the L-bar which carries the tubular section 21 is strengthened by a reinforcing plate 25 which joins the free edges of both legs. The reinforcing plate 25 extends in parallel to those surfaces of the crossbar 16 and corner support 17 of the respective end frame 11 which face the tank 10.

In the modification according to FIG. 4 each diagonal strut 20' includes an inner L-bar 26 having the tubular section 21 welded to one leg 27 thereof and having the outer edges of both its legs welded to the inner surfaces of an outer L-bar 28. The outer L-bar 28 is in turn welded by the outer surface of its leg 29 to the crossbar 16 and corner support 17 of the respective end frame 11.

This concept permits a compensation of length and shape tolerances during assembly of the tank container. If, for instance, the diagonal strut 20' is moved radially to the tank axis either inwards or outwards, the distance between the leg 27 of the L-bar 26 and the curved tank end 12 will also change. At the same time the angle at which the outer surface of the leg 27 of the L-bar 26 extends can be varied by varying the position of the L-bar 26 relative to the L-bar 28. The configuration shown in FIG. 4 offers the further advantage that the entire diagonal strut 20' is given a hollow profile of increased strength.

The embodiment shown in FIG. 5 differs from the one shown in FIG. 4 in that the inner L-bar 26 is replaced by a plate strip 39 the outer surface of which is welded to the tubular section 21. As illustrated in the example of FIG. 5, the plate strip 30 is welded at its bottom edge to the inner surface of one leg of the outer L-bar 28', while the edge of the other leg of the L-bar 28' is welded to the surface of the plate strip 30 facing away from the tubular section 21. In the embodiment of FIG. 5 the orientation of the surface carrying the tubular section 21 can likewise be varied by changing the position of the plate strip 30 relative to the L-bar 28' prior to welding. In the modification of FIG. 6 the tubular section 21 is not welded directly to the spherically curved main portion 13 of the tank end 12 as in the embodiment shown in FIGS. 1 and 2, but is welded thereto by means of a spherical cap element 31. The spatial orientation of the tubular section 21 may thus be varied as required prior to welding. The welds between the cap element 31 and the tank end 12, on the one hand, and between the cap element 31 and the tubular section 21, on the other hand, may be formed without any gap irrespective of the mutual orientation.

In the embodiment illustrated in FIG. 7 the same variability as to the orientation of the tubular section 21 is achieved in that, instead of the spherical cap element 31 of FIG. 6, a cone-shaped sleeve 32 is used which is welded to the spherically curved main portion 13 of the tank end 12 by its base edge which is normal to the cone axis and circular. Similar to what is shown in FIG. 6, the edge of the tubular section 21 may either be attached to the conical outer surface of the sleeve 32 or, as illustrated in FIG. 7, may be welded within a circular opening provided at the cone vertex.

If the modification of the diagonal strut illustrated in FIG. 4 or FIG. 5 is employed for at least one of the two end-side mountings between the tank 10 and the respective end frame 11 and, at the same time, one of the modifications illustrated in FIG. 6 or FIG. 7 is used for securing the tubular section 21 to the tank end 12, it will be possible to compensate for any tolerances in respect of length and tank end shape during the subsequent assembly. To this end, the four spherical cap elements 31 or, respectively, the four conical sleeves 32 are initially welded at predetermined locations to the main portion 13 of the tank end 12. Then, the L-bars 28 or 28' are welded to those locations on the end frame 11 held relative to the tank 10 where the distance from the tank end corresponds to the length of the respective tubular section. Finally, the L-bars 26 of FIG. 4 or plate strips 30 of FIG. 5, to which the tubular sections 21 have already been welded, are welded at proper orientation inside the outer L-bars 28 or 28' and the tubular sections 21 are welded by their other ends in the established position to the cap elements 31 or sleeves 32.

FIG. 2 shows the tank container in horizontal position with the tank axis extending horizontally. However, in use the container may also be exmployed in a position turned by 90° with the tank axis vertical. In the latter position the functions of the structural elements initially called longitudinal bars 19 and corner supports 17 are reversed.

I claim:

1. A transport container comprising a cylindrical tank, the tank ends of which each include a spherically curved main portion, two rectangular end frames each having four diagonal struts for bridging the corners thereof, and mounting structures inserted between the spherical main portion of each tank end and the diagonal struts of the respective end frame, each mounting structure comprising four circular-cylindrical tubular sections each extending at an acute angle to the tank axis and being joined with its one cut edge to the main portion of the respective tank end and with its other cut edge to a diagonal strut of the respective end frame, each tubular section having a diameter which is smaller by a multiple than the diameter of the tank and a length which is substantially of the order of its diameter.

2. The container of claim 1, wherein the diagonal strut comprises an L-bar.

3. The container of claim 2, wherein both cut edges of the tubular section are substantially normal to the axis thereof.

4. The container of claim 2, wherein the tubular section is welded to the one leg of the L-bar and the outer edges of the two legs of the L-bar are joined to the corner support and crossbar of the respective end frame.

5. The container of claim 4, wherein the L-bar includes legs of different width and said other cut edge of the tubular section is welded to the wider leg.

6. The container of claim 5, wherein the L-bar at least in the region where the tubular section is attached is complemented by a reinforcing plate to form a triangular-section element.

7. The container of any one of claim 2, wherein the outer edges of the two legs of the L-bar are welded to the inner surfaces of the legs of a further L-bar which is in turn joined to the corner support and crossbar of the end frame.

8. The container of claim 2, wherein the tubular section is welded to a surface of a plate strip which is welded to an L-bar joined to the corner support and crossbar of the end frame to form a triangular-section diagonal strut.

9. The container of claim 1, wherein said one cut edge of the tubular section is joined to the tank end by way of a spherical cap element having a substantially smaller radius of curvature than the main portion of the tank end.

10. The container of claim 1, wherein the tubular section is joined to a conical sleeve welded to the tank end by a circular base edge which is normal to the cone axis.

* * * * *